United States Patent [19]

Roe

[11] 3,987,423

[45] Oct. 19, 1976

[54] IONIZATION-CHAMBER SMOKE DETECTOR SYSTEM

[75] Inventor: Robert F. Roe, Jackson, Ohio

[73] Assignee: The United States of America as represented by the United States Energy Research and Development Administration, Washington, D.C.

[22] Filed: Dec. 22, 1975

[21] Appl. No.: 643,466

[52] U.S. Cl. ..... 340/237 S; 250/381

[51] Int. Cl.[2] ..... G08B 17/10; G08B 17/12

[58] Field of Search ..... 340/237 S; 250/381, 250/382, 384, 385, 389

[56] References Cited

UNITED STATES PATENTS

| | | | |
|---|---|---|---|
| 2,646,556 | 7/1953 | Allen | 340/237 S X |
| 2,759,174 | 8/1956 | Brailsford | 340/237 S |
| 2,809,317 | 10/1957 | Meili | 340/237 S X |
| 2,981,840 | 4/1961 | Nahmias | 340/237 S |
| 3,018,376 | 1/1962 | Vanderschmidt | 340/237 S X |
| 3,160,866 | 12/1964 | Meili | 340/237 S |
| 3,235,858 | 2/1966 | Mäder | 340/237 S |
| 3,245,067 | 4/1966 | Blevins | 340/237 S X |
| 3,271,756 | 9/1966 | Crawford et al. | 340/237 S |
| 3,295,121 | 12/1966 | Meyer | 340/237 S |
| 3,564,524 | 2/1971 | Walthard et al. | 340/237 S |

*Primary Examiner*—Donald J. Yusko
*Assistant Examiner*—Daniel Myer
*Attorney, Agent, or Firm*—John A. Horan; David S. Zachry; Fred O. Lewis

[57] ABSTRACT

This invention relates to an improved smoke-detection system of the ionization-chamber type. In the preferred embodiment, the system utilizes a conventional detector head comprising a measuring ionization chamber, a reference ionization chamber, and a normally non-conductive gas triode for discharging when a threshold concentration of airborne particulates is present in the measuring chamber. The improved system is designed to reduce false alarms caused by fluctuations in ambient temperature. Means are provided for periodically firing the gas discharge triode and each time recording the triggering voltage required. A computer compares each triggering voltage with its predecessor. The computer is programmed to energize an alarm if the difference between the two compared voltages is a relatively large value indicative of particulates in the measuring chamber and to disregard smaller differences typically resulting from changes in ambient temperature.

10 Claims, 4 Drawing Figures

IONIZATION-CHAMBER SMOKE DETECTOR SYSTEM

BACKGROUND OF THE INVENTION

This invention relates broadly to ionization-chamber smoke detectors, or aerosol detectors, and more particularly to an improved smoke-detection system utilizing one or more such detectors. This invention was made in the course of, or under, a contract with the Energy Research and Development Administration.

Referring to FIG. 1, smoke-detection systems of the ionization-chamber type commonly include two ionization chambers 1 and 3 which are connected in series across a d.c. voltage supply 5. Each chamber includes a pair of spaced electrodes 7 and 9 for establishing an electric field therebetween. The detector chamber 1 is open to atmosphere, whereas the reference chamber 3 contains air but is virtually sealed from atmosphere. As shown, each chamber is provided with at least one radioactive source 11 for ionizing air molecules therein, the resulting ions being attracted toward the chamber electrodes. As a result, a very small ionic current flows through the external circuit connecting the electrodes of the chamber. A comparative rapid increase in the number of visible or invisible particles in the air being sampled by the chamber 1 causes a decrease in its ionic current.

The reference chamber 3 is operated in the ionically saturated state and constitutes a constant-current device having a very high dynamic resistance. Thus, a decrease in the ionization current through the detector chamber 1 produces a relatively large voltage change at the junction 13 of the chamber. A gas triode 15 is connected across the chambers, with its starter electrode 17 connected to the junction 13 and its cathode connected to the negative electrode of detector 1. The triode 15 normally is in the non-conductive state, but if the number of particles in the detector chamber increases relatively rapidly to a so-called threshold value, the voltage across the chamber increases to a value exceeding the triggering, or breakdown, voltage for the cathode-to-starter-electrode portion of the triode. This initiates a cathode-to-starter current, which in turn initates a relatively heavy discharge between the cathode and anode of the tube. This discharge energizes an alarm relay 21, which in turn energizes an alarm 22. A normally closed reset switch 23 is provided for opening the anode circuit, thus returning the triode to the non-conductive state and resetting the detector system. The ionization chambers 1, 3 and the triode 15 commonly are designed as a compact assembly, or "detector head".

When a threshold concentration of airborne particulates is present in the detector chamber 1 (FIG. 1), appreciably less voltage is required to trigger the triode 15. In general, the larger the concentration of contaminants, the lower the voltage required for triggering the tube. The triggering voltage also varies with ambient temperature, but typically to a smaller extent.

A smoke-detection system of the kind described above is subject to the disadvantage that its sensitivity is adversely affected by high ambient temperatures. The detector head can be calibrated for operation at a high ambient temperature—say, 150° F—but is subject to false alarms if the temperature decreases appreciably below the calibrated value. Furthermore, the detector head may lose sensitivity if exposed for several hours to a temperature appreciably higher than the calibrated value. Thus, the typical smoke-detection system of the ionization-chamber type is not well suited for use in environments where the temperature is high and variable. For instance, such a system would not operate reliably if the detector head were mounted near intermittently operated equipment whose operation increases the ambient temperature from a normal value of about 70° F to a value of 150° F. The typical system also tends to lose sensitivity if in the dormant (unfired) state for extended periods.

SUMMARY OF THE INVENTION

Accordingly, it is an object of this invention to provide an improved smoke-detection system of the ionization, or ionization-chamber, type.

It is another object to provide an ionization smoke-detection system having improved reliability for operation at relatively high temperatures for extended periods.

It is a further object to provide an ionization smoke-detection system having improved reliability for operation at relatively high and variable temperatures.

Other objects of the invention will be made evident hereinafter.

This invention can be summarized as follows: A system for detecting particulates in an air atmosphere comprising: a voltage supply; a circuit connected across said supply, said circuit including a resistence element connected in series with an ionization chamber, said chamber being open to said atmosphere and including a pair of electrodes for establishing field in a region therebetween and a radioactive source for ionizing molecules of air in said chamber; a normally non-conductive gas-discharge triode coupled to said circuit for conducting current when a threshold concentration of airborne particulates is admitted to said chamber, said triode having a starter electrode; first means for intermittently and momentarily impressing on said starter electrode a ramp voltage which increases to a value initiating discharge of said triode; second means for restoring said triode to the non-conductive state following each such discharge thereof; and third means including alarm means for comparing at least one of the ramp-voltage values at which discharge of said triode is initiated with a reference voltage value and effecting an alarm when the voltage values so compared differ by more than a preselected amount.

DESCRIPTION OF THE PREFERRED EMBODIMENT

This invention is generally applicable to smoke-detection systems of the kind including a measuring ionization chamber connected in series with a high-value resistance element, a gas-discharge triode being coupled to the series combination to discharge when the ionic current through the measuring chamber decreases by a selected amount. For brevity, the invention will be illustrated in terms of an improved form of the dual-ionization-chamber system described above and shown in FIG. 1. The improved system can consist throughout of conventional components.

Figure 1:
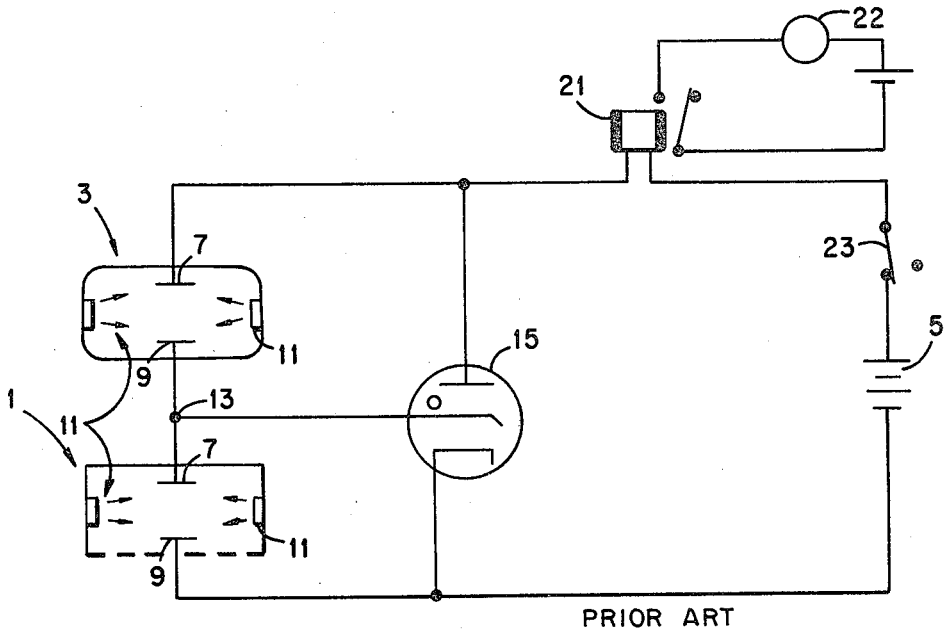
FIG. 1 is a schematic diagram of a prior-art smoke-detection system employing two serially connected ionization chambers.
Figure 2:
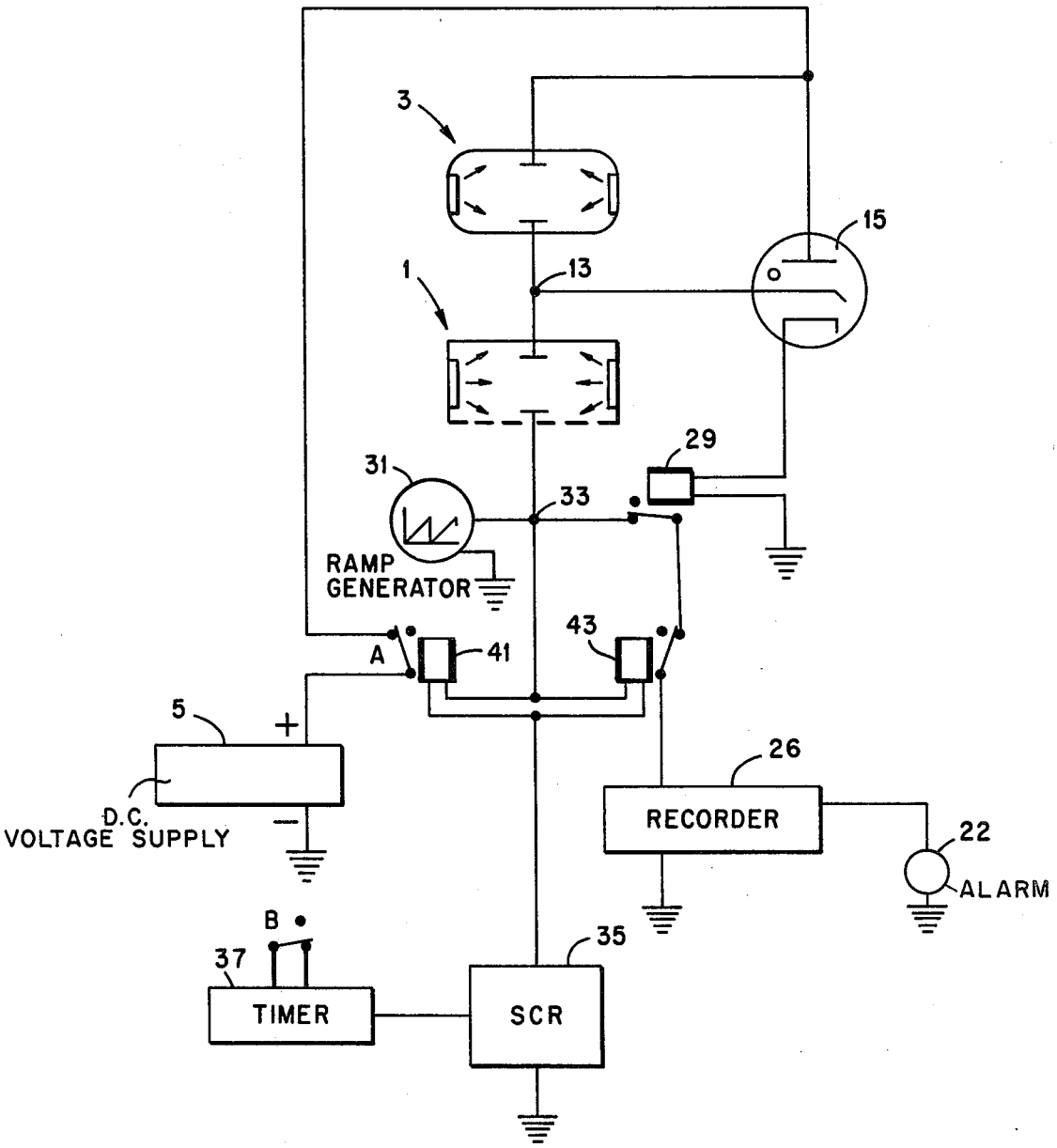
FIG. 2 is a schematic diagram of a dual-ionization-chamber-smoke-detection system designed in accordance with this invention.

FIG. 2 is a simplified showing of one form of the improved system. Where components of FIG. 2 correspond to components of FIG. 1, they are designated by like numbers. As shown, a series circuit consisting of a measuring ionization chamber 1, a reference ionization chamber 3, and a recorder/comparator 26 is connected across a d.c. voltage supply 5. The recorder/comparator (hereinafter referred to as a recorder) can be an Esterline-Angus Speed Servo II and is provided to selectively energize an alarm 22. The series circuit just described is paralleled by a series combination of a normally non-conductive triode 15 and a relay 29. The triode is connected in the usual fashion, to discharge if the ionic current through the measuring chamber 1 decreases by a given amount. A ramp-voltage generator 31 has its output connected to the cathode of chamber 1 at a terminal 33. The generator impresses across the cathode and starter electrode of tube 15 a linearly increasing voltage (ramp voltage). The generator 31 can be of standard design, and preferably is provided with adjustments for altering the magnitude and period of its output. One such generator is Model No. 5400A, manufactured by Krohn-Hite Corporation, Cambridge, Mass.

As shown, two control relays 41 and 43 are connected in parallel between terminal 33 and a silicon-controlled-rectifier 35. The gate of the SCR is connected to a pulse-generating timer 37 for periodically turning on the SCR. The period of the timer is made sufficiently long to ensure that the ramp voltage reaches a value sufficient to fire the triode 15. On timing out, the timer turns on the SCR, thus grounding the generator 31 through the control relays, with the result that relay 41 resets the triode and restarts the timer. Thus, the generator 31 impresses across the cathode and starter electrode of triode 15 a train of ramp voltages, each of which fires the triode. The timer 37 can be of standard design and may be Timer Model No. TDE-120-AKA, manufactured by Diversified Electronics, Inc., Evansville, Ind. As shown, the aforementioned relay 41 has normally closed contacts A and B, contact A being in the line connecting the power supply to the detector head, and contact B being in the reset circuit for the timer. Relay 43 has a similar contact in a line connecting terminal 33 to the recorder. An output terminal of the recorder is connected to any suitable alarm means 22. As will be described, the recorder stores the voltage at which the triode fires; compares that voltage with a reference, or set, voltage; and energizes the alarm if the stored voltage is less than the set voltage. The set voltage is preselected to discriminate against the decreases in firing voltage resulting from typical changes in the ambient temperature. In other words, the reference voltage is set at a value which is (1) low enough so that the alarm is not energized if the firing voltage decreases by an amount characteristic of ambient temperature changes and (2) high enough so that the alarm is energized by the larger decreases resulting from a threshold concentration of particulates in the detector chamber.

Assuming a non-alarm concentration of airborne particulates in chamber 1, the system of FIG. 2 operates as follows: The output of the ramp-generator 31 is applied to terminal 33 and thus across the cathode-to-starter portion of the triode and also across the recorder. The recorder stores the ramp voltage as it reaches a value sufficient to discharge the triode. Discharge of the triode energizes relay 29, opening its contact to disconnect the ramp voltage from the recorder. Thus, the value of the ramp voltage stored in the recorder corresponds to the value of the ramp voltage required to trigger the triode during this particular cycle. The ramp voltage impressed on terminal 33 continues to rise until the timer 37 times out. The timer then gates the SCR on, discharging the ramp-generator through the relays 41 and 43, energizing these relays momentarily and reducing the ramp-generator output essentially to zero. Relay 41 opens its contact momentarily to disconnect the voltage supply 5 from the detector head (1, 3, 15), thus re-setting the head by returning the triode to the non-conducting state. Also, relay 43 opens its contact momentarily, isolating the recorder from the ramp-generator while the latter is discharging.

In the absence of an alarm condition, the cycle just described is repeated indefinitely. During each cycle the ramp generator fires and re-sets the detector head, and the recorder stores whatever ramp voltage is required to trigger the triode. The recorder compares the trigger voltage for each cycle with the aforementioned set voltage and energizes the alarm 37 only if the stored ramp voltage is below the set level. That is, the system does not alarm in response to typical variations in ambient temperature, but it does alarm in response to a threshold concentration of particulates in the detector chamber 1. Thus, the system shown in FIG. 2 provides an important advantage over the conventional system shown in FIG. 1, since the latter is subject to false alarms resulting from changes in ambient temperature.

Another advantage of the improved system is that it eliminates the so-called "firing history" effect. This refers to the tendency of conventional systems to fail to detect particulates following a relatively long period of detector dormancy. This problem does not arise in the improved system, since the detector head is fired periodically.

Figure 3:
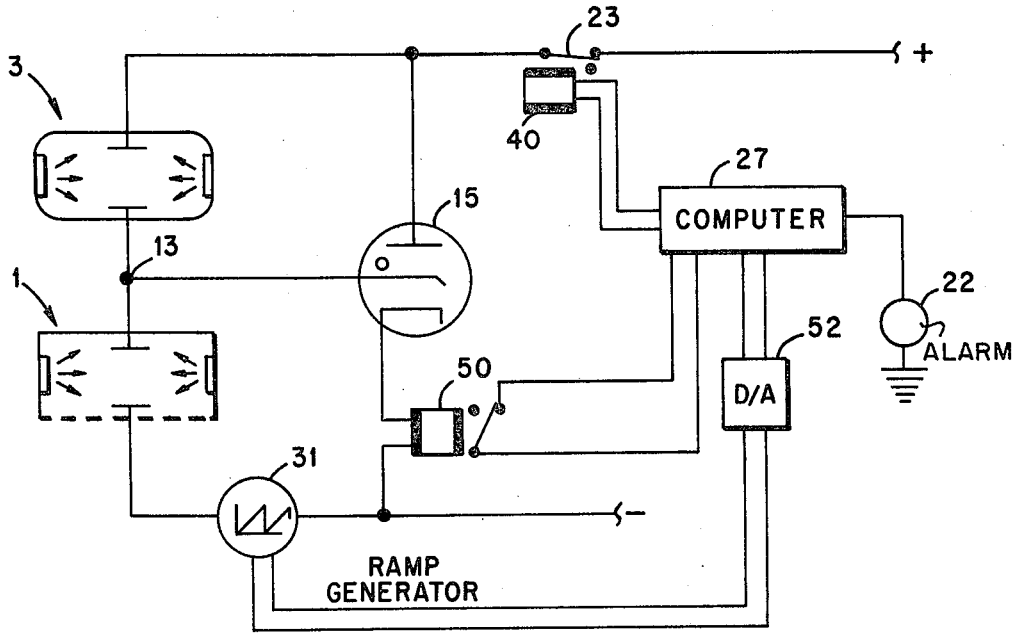
FIG. 3 is a schematic diagram of another form of the invention.

FIG. 3 illustrates a somewhat different and more versatile embodiment of the invention. This embodiment also includes a ramp-generator 31 for periodically firing the gas triode 15, and means for storing the ramp-voltage value at which each firing of the triode occurs. However, in this form of the system each of the successively stored ramp voltages is not compared to a set voltage. Instead, each stored ramp voltage is compared with the ramp voltage stored in the cycle following, and the alarm 22 is energized only if the difference between the two successively stored voltages is a relatively large amount indicative of a threshold concentration of particulates being present in the detector chamber. The system shown in FIG. 3 utilizes a computer to: supply the input for the ramp-generator 31; store the ramp voltage values at which firing of the triode occurs; re-set the system following firing of the triode; compare each stored voltage with the next; and energize the alarm 22 if the difference between any of the voltages so compared exceeds a preselected amount.

The system shown in FIG. 3 can consist throughout of standard components. The computer 27 can, for example, be Digital Computer Model PDP 11/20, manufactured by Digital Equipment Corporation. The computer 27 is programmed to supply the input to the ramp-generator 31 through a standard digital-to-analog converter 52. The ramp-generator can, for example, by an operational amplifier for linearly amplifying the converter output (e.g., a 0–5 volt DC signal) to a suitable value for firing the triode 15. The frequency of the ramp-generator output is selected to fire the triode at any suitable intervals. As shown, a control relay 50 is connected in series with the triode and is provided with a normally closed contact connected in circuit with the computer. Discharge of the triode energizes the relay, opening its contact. This triggers the computer to store the value of the ramp voltage obtaining at this instant. The ramp generator output continues to rise to its maximum, after which it drops to zero. The computer then momentarily energizes relay 40 to operate the reset switch 23 which de-ionizes the triode, de-energizing relay 50 and thus reclosing the contact at this relay to ready the system for the next cycle. The computer determines the difference between each two successively stored ramp voltages. If this difference exceeds a preselected value (i.e., if the difference is a relatively large amount indicative of a threshold concentration of particulates in the detector chamber), the computer energizes the alarm 22. The computer does not act to energize the alarm if the difference in the preselected value can be determined empirically at a given ambient temperature by exposing the detector head to increasing concentrations of airborne particulates while observing the ramp-voltage value at which firing of the gas triode is initiated.

Figure 4:
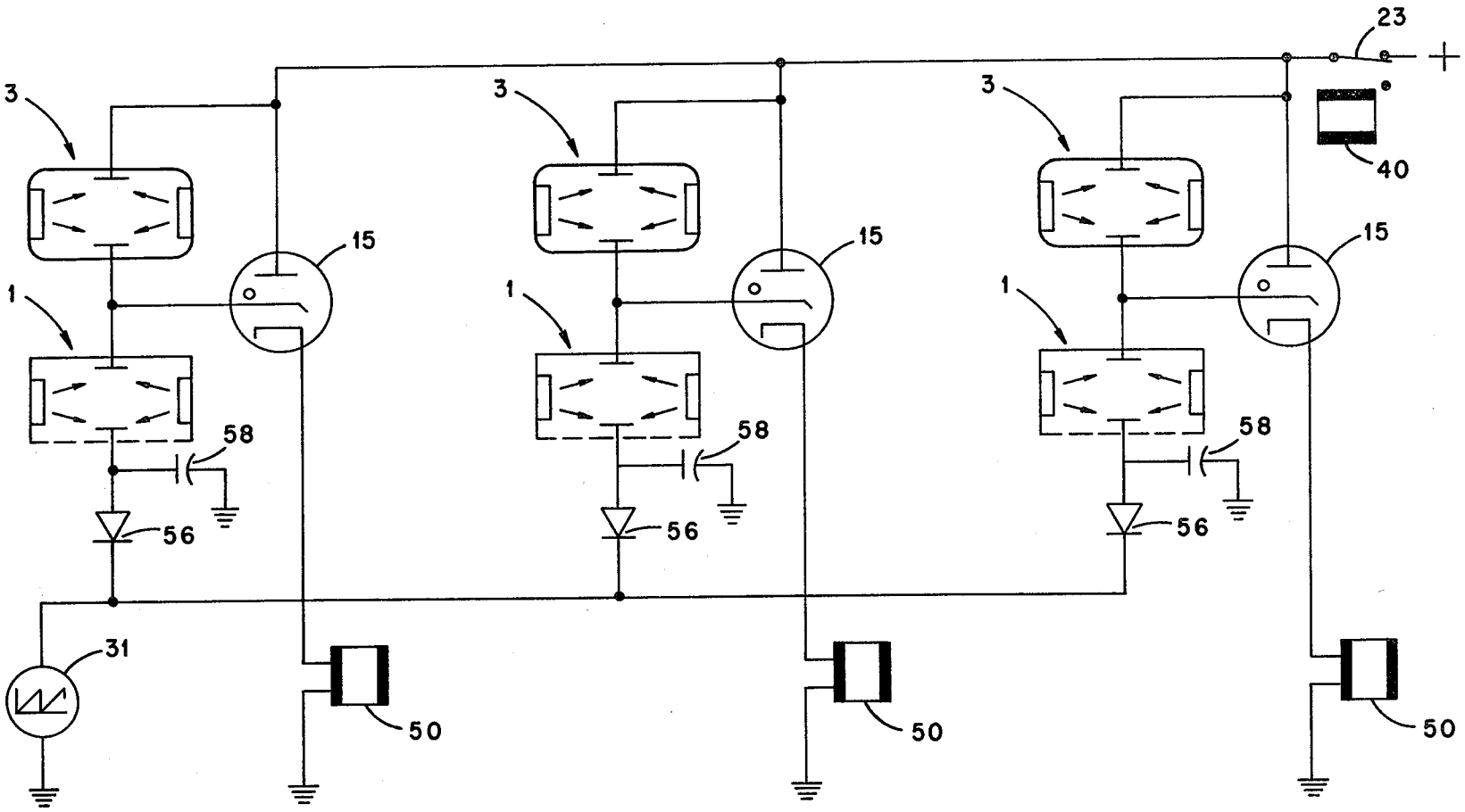
FIG. 4 is a schematic diagram of part of the circuit of FIG. 3 as modified to permit the use of a single ramp generator with a plurality of detector heads.

The system shown in FIG. 3 can be adapted to operate virtually any number of detector heads 1, 3, 15. As indicated in FIG. 4, a single ramp-generator 31 can be used to fire a plurality of detector heads if the triggering electrodes for the various gas triode 15 are suitably isolated from one another. Suitable isolation can be provided by connecting a standard diode 56 in the line between the generator and each detector head, and by connecting a capacitor 58 between the line and ground, as shown. This reduces the voltage kick on the ramp-generator output when a detector head fires. One reset switch 23 and one reset relay 40 are provided for all heads, as shown. When anyone of the detector heads fires and energizes its relay 50, the computer stores the ramp voltage being applied to that detector head at that instant. It compares this stored voltage with the voltage stored in the next operation of that same detector head and energizes the alarm 22 if this is warranted. As the ramp continues to rise toward its maximum, the computer operates in analogous fashion for each of the other detector heads.

Tests were conducted with a system similar to that shown in FIGS. 3 and 4, with the exception that four detector heads were employed in parallel. Each of the heads was a Model 3/5 Pyr-A-Larm, manufactured by Pyrotronics, Incorporated. (The triggering voltage for this particular head typically increases approximately 0.1 volt per 1° F increase in ambient temperature.) The computercontrolled output from the generator 31 was a 70-volt ramp which was impressed on the starter electrodes of the triodes every 36 seconds.

The four detector heads were mounted equidistantly along the length of the ceiling of an air-containing chamber having a volume of about 140,000 cu. ft. The air temperature in the chamber exceeded 150° F and was subject to variation. The computer 27 for the system was pre-set to energize an audible alarm if the difference in any two successive triggering voltages exceeded 5 volts. With no smoke in the chamber, the triggering voltage for the typical triode was in the range 0f 30–35 volts. Nineteen smoke-detection tests were conducted by introducing smoke to the room at various locations and at various rates. In each instance, admission of the smoke initiated an alarm. There were no false alarms in the course of the test, despite the variable temperature. In each instance, the detector head closest to the smoke inlet alarmed first. The time elapsing between introduction of smoke and sounding of the alarm varied from about 70 seconds to 150 seconds.

The system of FIGS. 3 and 4 provides important advantages over conventional systems of the kind illustrated in FIG. 1. In both types of systems the triode-triggering voltage varies somewhat with changes in the ambient temperature but to a considerably larger extent when there is a threshold concentration of particulate contaminants in the air being monitored by the detector chamber 1. The prior-art detection system does not discriminate between temperature-induced variations and contaminant-induced variations, and thus is subject to false alarms. The improved system exericses such discrimination, however, because the computer is programmed to energize the alarm only if two successive triggering voltages differ by the relatively large amount indicative of a threshold concentration of contaminants in the detector chamber. In some environments, it may be typical for the ambient temperature to vary by such a large amount that the resulting difference between two successive triggering voltages is about the same as the difference produced by an alarm concentration of contaminants. In that event, the temperature-induced difference between successive triggering voltages can be made relatively small by increasing the frequency of the generator output and reducing the time between successive firings of the triode. As a result, the detector head experiences a smaller change in temperature in the period between firings and can discriminate between the relatively small variations effected by temperature change and the relatively large variations effected by contaminants. It will be understood that the system of FIGS. 3 and 4 also provides the advantage of eliminating the above-mentioned firing-history effect encountered in conventional systems. As mentioned, detector heads typically become less sensitive with increases in the ambient temperature, and in the conventional system shown in FIG. 1 such increases may cause the detector head to fail to "see" contaminants. In the system shown in FIG. 3, however, the introduction of contaminants would give an alarm, since the computer (FIG. 3) compares successive firing voltages.

It will be apparent that various modifications in the illustrated embodiments can be made within the scope of the invention as set forth in the appended claims. For instance, instead of comparing the firing voltages for two immediately succeeding cycles, the system could be designed to compare them for every other cycle or every twenty cycles, and so on. The various relays can be electronic switches, if desired. In FIG. 3, the relay 50 could be replaced by a voltage divider for generating an input voltage to the computer 27. Again, the computer shown in FIG. 3 could furnish the ramp voltage by supplying a digital signal to a conventional programmable power supply, in which the digital-to-analog converter 52 and the operational amplifier 31 would not be required.

As used herein, the term "reference voltage" includes a pre-selected set voltage or a stored triggering voltage. The term "computer" is used herein to include both hard-wired and soft-wired circuitry.

What is claimed is:

1. A system for detecting particulates in an air atmosphere comprising:

a. a voltage supply, b. a circuit connected across said supply, said circuit including a resistance element connected in series with an ionization chamber, said chamber being open to said atmosphere and including a pair of electrodes for establishing an electric field in a region therebetween and a radioactive source for ionizing molecules of air in said chamber, c. a normally non-conductive gas-discharge triode coupled to said circuit for conducting current when a threshold concentration of airborne particulates is admitted to said chamber, said triode having a starter electrode, d. first means for intermittently and momentarily impressing on said starter electrode a ramp voltage which increases to a value initiating discharge of said triode, e. second means for restoring said triode to the non-conductive state following each such discharge thereof, and f. third means including alarm means for comparing at least one of the ramp-voltage values at which discharge of said triode is initiated with a reference voltage value and effecting an alarm when the voltage values so compared differ by more than a pre-selected amount.

2. The system of claim 1 wherein said resistance element is an ionization chamber which is virtually sealed from said atmosphere and which includes a pair of electrodes for establishing an electric field in a region therebetween and a radioactive source for ionizing molecules of air in the sealed chamber.

3. The system of claim 1 wherein said reference voltage is another of said ramp-voltage values.

4. The system of claim 1 wherein said means for comparing is a computer.

5. The system of claim 4 wherein said computer is coupled to said triode by switching means for disconnecting said computer from said triode upon discharge of said triode.

6. The system of claim 4 wherein said computer is coupled to said triode through switching means for resetting said triode to the non-conductive state after each discharge thereof.

7. The system of claim 4 wherein said first means includes means for generating a ramp voltage and means for periodically reducing the output thereof to substantially zero.

8. A system for detecting particulates in air comprising:

a. a voltage supply, b. a circuit connected across said supply, said circuit including a resistance element connected in series with an ionization chamber, said chamber being open to air and including spaced electrodes for establishing an electric field therebetween and a radioactive source for ionizing molecules of air in said chamber, c. a normally non-conductive gas-discharge tube connected across said circuit and having a starter electrode connected to the junction of said chamber and resistance element, for conducting in response to the presence of a threshold concentration of airborne particulates in said chamber, d. means for intermittently and momentarily impressing on the starter electrode of said tube a ramp voltage which increases to a value initiating discharge through said tube, e. means for restoring the tube to the non-conductive state following each such discharge, and f. computer means for comparing the ramp-voltage values at which two such discharges of said tube are initiated, and for generating an alarm signal if the ramp-voltage value initiating the earlier of said discharges exceeds the ramp-voltage value initiating the later of said discharges by more than a selected amount.

9. The system of claim 8 wherein said ramp-voltage values initiating two discharges of said tube triode are generated in immediately succeeding operating cycles of the system.

10. The system of claim 8 wherein said means for impressing a ramp voltage on the starter electrode of said tube is connected to said electrode through a diode.

* * * * *